United States Patent [19]

Muehling

[11] 4,095,370

[45] Jun. 20, 1978

[54] BAND-TYPE WINDOW REGULATOR FOR VEHICLES

[76] Inventor: Anthony A. Muehling, 14583 Maddelein, Detroit, Mich. 48205

[21] Appl. No.: 761,915

[22] Filed: Jan. 24, 1977

[51] Int. Cl.[2] ..... E05F 11/48

[52] U.S. Cl. ..... 49/352; 49/375

[58] Field of Search ..... 49/348, 349, 352, 353, 49/227, 374, 375

[56] References Cited

U.S. PATENT DOCUMENTS 3,702,041 11/1972 Podolan ..... 49/348

FOREIGN PATENT DOCUMENTS 588,041 1/1925 France ..... 49/352

*Primary Examiner*—Kenneth Downey

*Attorney, Agent, or Firm*—Reising, Ethington, Barnard, Perry & Brooks

[57] ABSTRACT

A vehicle window regulator of the disclosure includes a band trained over upper and lower idler rollers whose axes of rotation are parallel to the window and each other and also trained over a manually driven drive roller located intermediate the idler rollers and rotatable about an axis perpendicular to a plane through the idler roller axes. An inboard reach of the band extends between the idler rollers and is trained over the drive roller while including a half twist so that the natural configuration thereof accommodates for the different orientations of the drive roller axis and the idler roller axes without stressing the band. An outboard reach of the band is secured to the window by a connector to move the window as the drive roller moves the band. Preferably, a vertically extending housing of the band includes upper and lower ends that mount the idler rollers and an intermediate portion that mounts the drive roller. At the intermediate housing portion, a one way clutch and a counterbalance spring are utilized in driving the band and providing counterbalancing of the window. Pressure applying rollers mounted on the intermediate housing portion engage the inboard band reach with the drive roller to maintain a driving relationship. Side walls of the band housing have the inboard reach of the band received therebetween while an outboard guide portion that connects the side walls defines a curved outer guide surface along which the window connector is slidably moved. Opposite ends of the band are secured to the window connector with one end being secured by an adjuster including a threaded connection for adjusting the band tension.

15 Claims, 7 Drawing Figures

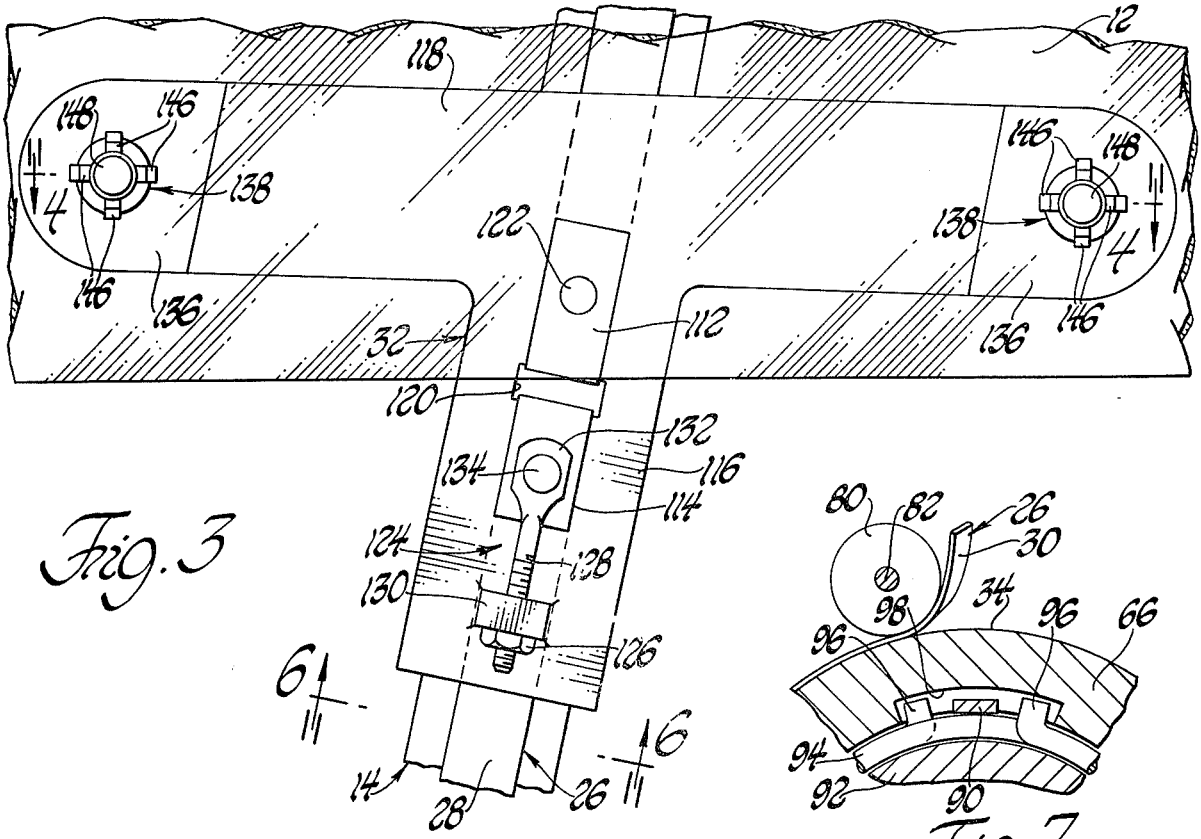
Fig. 3
Fig. 7
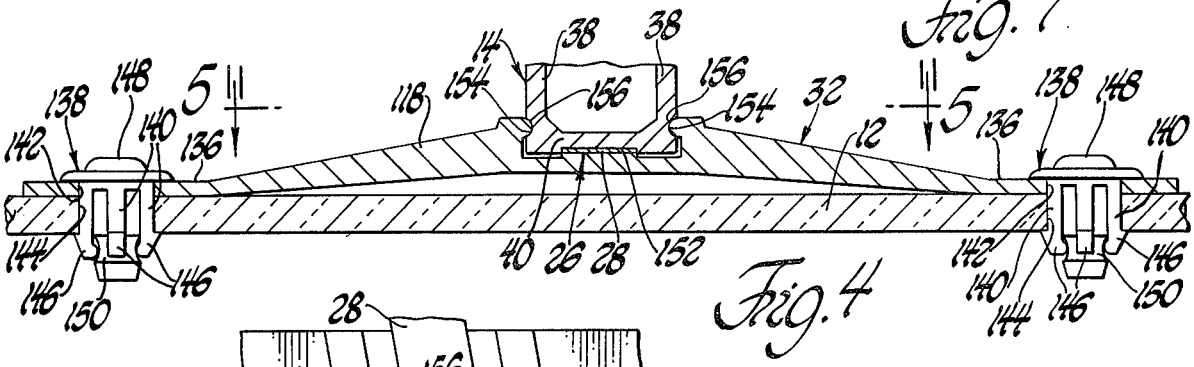
Fig. 4
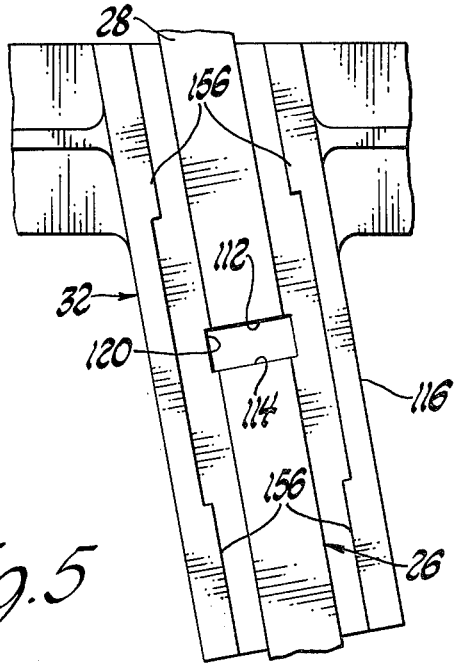
Fig. 5
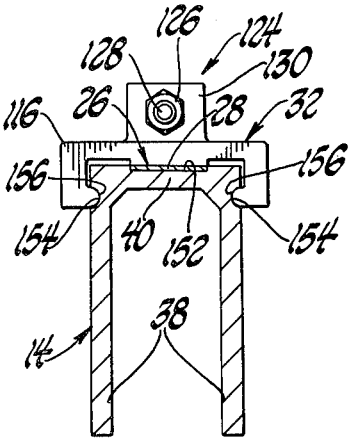
Fig. 6

BAND-TYPE WINDOW REGULATOR FOR VEHICLES

BACKGROUND OF THE INVENTION

1. Field of the Invention

This invention relates to a vehicle window regulator for moving an associated window between open and closed positions.

2. Description of the Prior Art

Vehicle window regulators conventionally include sector gears and cooperable pinion gears and are connected to associated vehicle windows by crank arms on the sector gears. A slidable connection between the crank arm and the window is utilized to provide vertical window movement while accommodating for the concomitantly changing horizontal relationship between the sector gear axis of movement and the window. Guides located along the front and rear edges of the associated window are utilized to control positioning thereof in cooperation with the window regulator. Manually driven rotation of the pinion that drives the sector gear conventionally takes place about a horizontal axis that is generally perpendicular to the direction of window movement.

Some current production vehicles have windows which are curved between their upper and lower edges and move generally along a curved path between an upper closed position and a lower open position. These windows must be controlled by a regulator whose operation accommodates for the curvature involved in moving the window between its open and closed position. With vehicle side windows, this curvature is in a direction inwardly when moving in an upward direction and is referred to as "tumble-home". A crank arm connected to such a curved window must flex in an inboard and outboard direction to accommodate for inboard and outboard movement of the window as it is raised and lowered between its open and closed positions.

Another type of window regulator disclosed by the prior art incorporates a drive cable that is trained over a drive roller and a number of idler rollers as well as being connected to the window so that driving movement of the cable moves the window between its open and closed positions. The drive roller utilized with this type of regulator usually has to have a driving groove that receives the cable in order to generate sufficient driving force therebetween to move the window. Such regulators as of yet have not been used extensively with production vehicles.

SUMMARY OF THE INVENTION

An object of the present invention is to provide an improved vehicle window regulator for moving a vehicle window between open and closed positions.

In carrying out the above object and other objects, the vehicle window regulator includes a band that is trained over upper and lower idler rollers whose axes of rotation extend horizontally parallel to the window and to each other. A manually driven drive roller mounted vertically intermediate the idler rollers is movable about an axis perpendicular to a plane through the idler roller axes so as to be driven by hand crank from within the vehicle on which the regulator is used. The band was a cross section of a greater lateral extent than its thickness. An inboard reach of the band is trained over the drive roller and has a half twist so that the total lateral extent of the band engages the idler and drive rollers without stressing the band. A window connector secured to an outboard reach of the band provides vertical window movement as the drive roller is manually rotated.

A preferred embodiment of the regulator includes a vertically extending housing having upper and lower ends that respectively mount the idler rollers and also having an intermediate portion that mounts the drive roller. Spaced side walls of the housing have the idler rollers mounted therebetween with the inboard reach of the band also located therebetween extending between the idler rollers. An outer guide portion of the housing connects the side walls to define a U shape that opens in an inboard direction. The guide portion has an outer curved guide surface along which the window connector is slidably supported. Oppositely opening curved grooves in the housing side walls preferably receive slide portions on the window connector to maintain the slidable support thereof along the guide surface.

Opposite ends of the band are preferably located along the outboard reach thereof and are secured to the window connector. A tension adjuster secures one of the band ends to the window connector and includes a threaded connection whose threading adjustment controls the band tension by controlling its effective length. The tension adjuster is preferably mounted on a lower vertical leg of the connector while an upper horizontal leg that defines a T shape with the vertical leg includes snap action attachers for securing the connector to the window.

At its intermediate portion, the regulator housing includes a one way clutch that drives the drive roller and a counterbalance spring for counterbalancing the window weight. Pressure applying rollers maintain a frictional driving relationship between the drive roller and the inboard reach of the band with the half twist.

The objects, features and advantages of the present invention are readily apparent from the following detailed description of the preferred embodiment taken in connection with the accompanying drawings.

BRIEF DESCRIPTION OF THE DRAWINGS

FIG. 3 is a view taken along line 3—3 of FIG. 1 and shows a window connector of the regulator;

FIG. 4 is a sectional view taken along line 4—4 of FIG. 3 showing the window connector;

FIG. 5 is a view of the window connector taken along line 5—5 of FIG. 4;

FIG. 6 is a view taken along line 6—6 of FIG. 3 showing the window connector and a U-shaped housing of the regulator; and FIG. 7 is a partial view taken along line 7—7 of FIG. 1 and shows a one way clutch of the window regulator.

DETAILED DESCRIPTION OF THE PREFERRED EMBODIMENT

Figure 1:
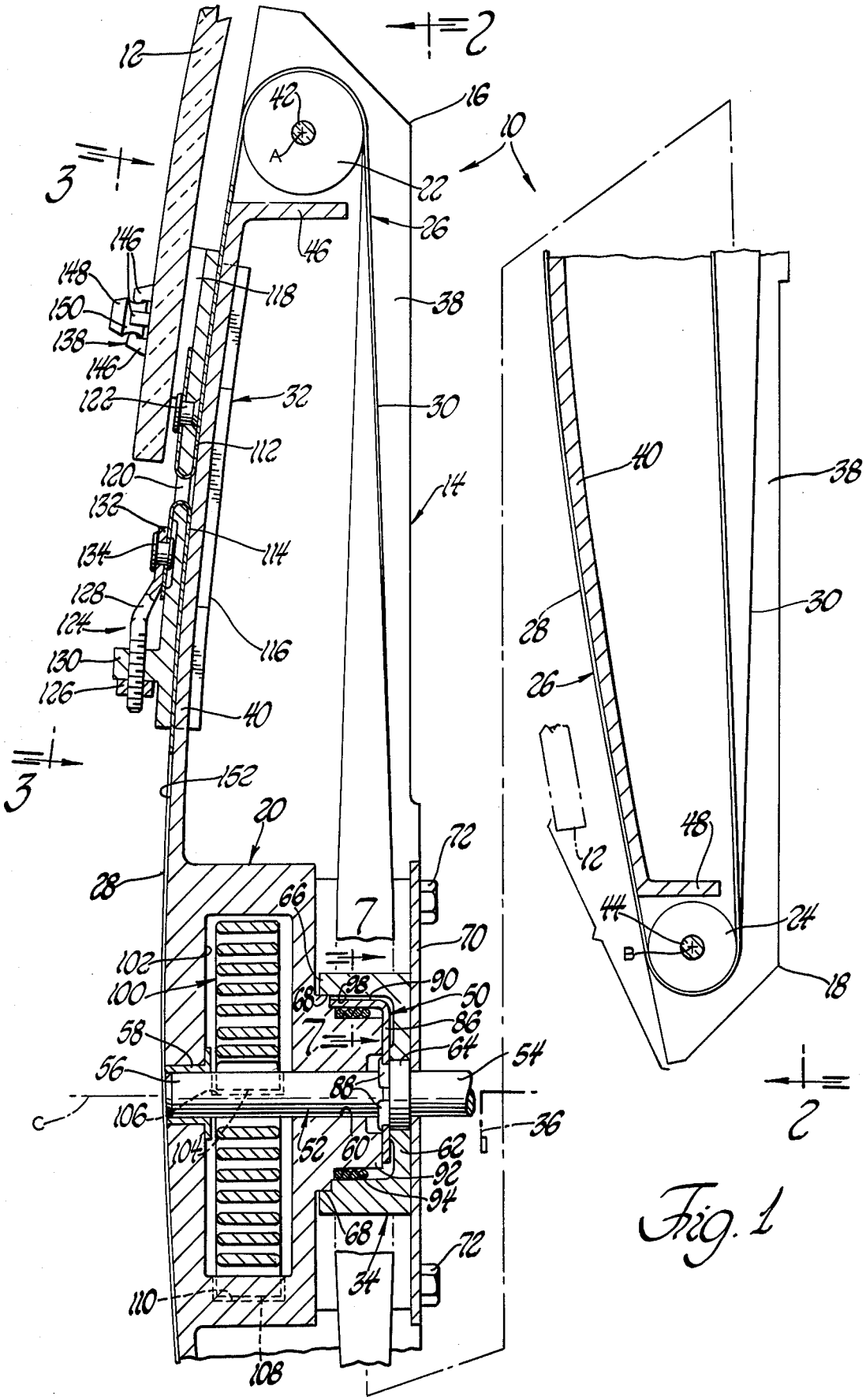
FIG. 1 is an elevation view in section of a vehicle window regulator constructed according to the present invention.
Figure 2:
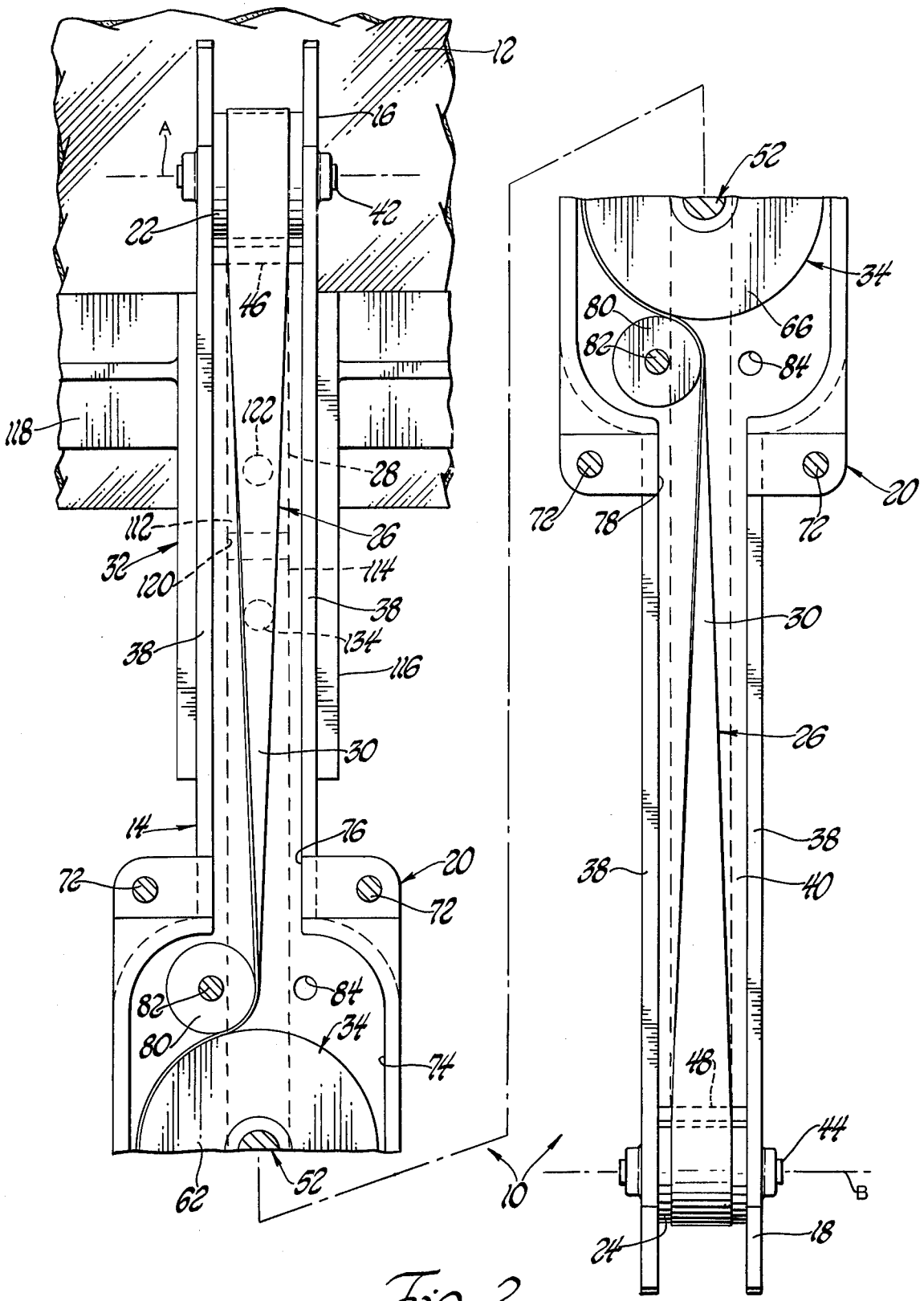
FIG. 2 is an elevation view of the regulator taken along line 2—2 of FIG. 1.

Referring to FIG. 1 of the drawings, a vehicle window regulator collectively indicated by 10 is operable to move a window 12 between an upper closed position shown by solid line representation and a lower open position shown by phantom line representation. Regulator 10 includes a vertically extending housing 14 molded from a suitable plastic and having upper and lower ends 16 and 18 as well as an intermediate portion 20. Upper and lower idler rollers 22 and 24 of the regulator are respectively supported by the upper and lower housing ends 16 and 18 for rotation about horizontal axes A and B that extend parallel to the plane of window 12 and to each other. An elongated band indicated generally by 26 is trained over the idler rollers 22 and 24 and includes outboard and inboard reaches extending between these rollers and indicated by 28 and 30, respectively. A connector 32 connects the outboard band reach 28 to the window 12 so that movement of the band moves the window vertically between its open and closed positions. A manually driven drive roller 34 is rotatably supported on the intermediate housing portion 20 for rotation about an axis C that extends perpendicular to a plane through the idler roller axes A and B and has the inboard band reach 30 trained thereover as shown in FIG. 2 so that rotation thereof moves the band in order to raise and lower the window 12. Band 26 is made from a suitable steel, plastic, or a laminated plastic and steel structure and has a cross section whose width is at least greater than its thickness. Preferably, the band cross sectional width is one hundred times or more greater than the thickness of the band. Between the upper and lower idler rollers 22 and 24, the inboard band reach 30 has a half twist (180°) that allows the total width of the band to engage each idler roller 22 and 24 and the drive roller 34 without stressing the band. Providing the half twist along the inboard band reach 30 permits the total lateral extent of the band to engage the idler rollers 22 and 24 while concomitantly engaging the drive roller 34 despite the different orientations between the idler roller axes A and B and the drive roller axis C. As such, a manual regulator crank handle 36 shown by phantom lines may be manually rotated by a vehicle passenger from within the vehicle with which the regulator is utilized in order to raise and lower the window in a manner that is more fully hereinafter described.

With combined reference to FIGS. 1 and 2, regulator housing 14 includes spaced side walls 38 extending between the intermediate housing portion 20 and its upper and lower ends 16 and 18. An outer guide portion 40 of a curved shape between the upper and lower housing ends connects the side walls 38 and defines an inwardly opening U shape best seen in FIG. 6. Horizontally extending shafts 42 and 44 extend between the housing side walls 38 at the upper and lower housing ends as best seen in FIGS. 1 and 2 and respectively support the upper and lower idler rollers 22 and 24 for rotation about their associated axes between the side walls. Upper idler roller 22 is located just above a housing end flange 46 that interconnects the side walls to provide support therebetween. Likewise, lower idler roller 24 is located just below an end flange 48 which also interconnects the side walls 38 to provide reinforcement. The inboard band reach 30 extends from the upper idler roller 22 to the lower idler roller 24 between the housing side walls 38.

At the intermediate housing portion 20 as best seen in FIG. 1, a one way clutch indicated collectively by 50 drives the drive roller 38 to provide the band movement that raises and lowers the window. Clutch 50 is supported by a shaft 52 whose inboard end 54 is manually rotated about axis C by crank handle 36 and whose outboard end 56 is supported on the housing along this axis by a bushing 58. Between its inboard and outboard ends 54 and 56, shaft 52 extends through a round opening 60 in the intermediate housing portion. Drive roller 34 has a cup shape with a disc portion 62 splined or otherwise suitably fixed to an enlarged portion 64 of shaft 52. An axial sleeve portion 66 of the drive roller 34 has an annular shape and extends from the disc portion 62 in an outboard direction. Slidably interengaged annular surfaces 68 on the intermediate housing portion 20 and at an open end of the drive roller sleeve portion 66 cooperate with the enlarged shaft portion 64 in rotatably supporting the drive roller about axis C. A plate 70 secured to the intermediate housing portion 20 by bolts 72 engages the drive roller disc portion 62 to maintain the drive roller with the clutch 50 located within its sleeve portion 66 as shown. In this assembled condition, drive roller 34 is located within an intermediate housing depression 74 (FIG. 2) that has upper and lower openings 76 and 78 through which the inboard band reach 30 extends to the upper and lower idler rollers 22 and 24. Upper and lower pressure applying rollers 80 supported by associated shafts 82 on the intermediate housing portion 20 within its depression 74 rollingly engage the inboard band reach 30 and maintain a frictional driving relationship thereof with the drive roller 34. Support holes 84 in the intermediate housing portion 20 allow the rollers 80 to be mounted by their associated shafts 82 on one side or the other of the shaft 52 so as to permit the regulator to be used on both right and left-hand sides of a vehicle without changing the direction of manually driven rotation required to move the window upwardly and downwardly.

As seen in FIG. 1, clutch 50 includes an input 86 that is suitably fixed to the shaft 52 such as by the stakes 88 so as to be rotated with the shaft as the shaft is driven by handle 36. An axially extending arm 90 of input 86 is also shown in FIG. 7 as being located radially outward from a round locking projection 92 that extends in an inboard direction from the intermediate housing portion. A helical locking spring 94 has several convolutions that encircle the housing locking projection 92 in engagement therewith and includes opposite ends 96 projecting outwardly into an opening 98 in the drive roller sleeve portion 66 as shown in FIG. 7. Clutch input arm 90 is located between the spring ends 96 within the opening 98. Manually driven rotation of the clutch input arm 90 in either a clockwise or counterclockwise direction engages it with one of the spring ends 96 and thereby applies a force to the spring 94 which tends to increase the spring diameter as the spring end engages the adjacent end of the drive roller sleeve portion opening 98. This increase in the diameter of spring 94 permits the spring convolutions to slide about the locking projection 92 as the rotation of clutch input arm 90 moves the drive roller in one direction or the other to raise and lower the window. However, forces applied to the window tending to move the band 26 and the drive roller 34 cause the sleeve portion 66 of the drive roller to engage one or the other of the spring ends 96 at one end of its opening 98 and to thereby move this spring end in a direction which tends to decrease the diameter of the spring 94. This decrease in the diameter of spring 94 locks it about the locking projection 92 to prevent reverse driving of the clutch and to thereby maintain the window in position against movement.

A counterbalance spring 100 shown in FIG. 1 is received within a chamber 102 in the housing intermediate portion 20 and functions to counterbalance the wieght of window 12 during movement between its open and closed positions. Spring 100 includes an inner end 104 received within a slot 106 in shaft 52. An outer end 108 of spring 100 is received within a slot 110 in the housing intermediate portion 20. Between its inner and outer ends 104 and 108, spring 100 is wound in a direction so that it provides the counterbalancing action of the window.

As seen by combined reference to FIGS. 1 and 3, opposite ends 112 and 114 of band 26 are disposed along the outboard band reach 28. Each band end is secured to a lower vertical leg 116 of the window connector 32 which also has an upper horizontal leg 118 that attaches the window and defines a slightly skewed but generally T shape with the vertical leg. Band ends 112 and 114 each extend through an opening 120 in the vertical connector leg 116. A rivet 122 fixedly secures the band end 112 to the window connector while an adjuster 124 adjustably secures the band end 114 to the connector. Adjuster 124 includes a threaded connection that secures the band end 114 by way of a nut 126 and a threaded member 128. An apertured lug 130 on the lower end of connector leg 116 recieves the lower threaded end of member 128 with the nut 126 engaging the lug from the lower side. An upper end 132 of member 128 is secured to the band end 114 by a rivet 134. Threading adjustment of nut 126 on member 128 changes the effective length of the band 26 so as to control its tension in an adjustable manner.

As seen by combined reference to FIGS. 3 and 4, the horizontal window connector leg 118 includes opposite ends 136 that are secured to the window 12 by attachers 138. Legs 140 of the attachers 138 extend through aligned openings 142 and 144 in the window connector leg ends 136 and in the window 12 with a snap action being provided as outer tangs 146 of the legs snap through the window hole. A headed lock member 148 of each attacher is subsequently inserted through a central opening thereof between the legs 140 and has an annular groove 150 that receives the leg tangs 146 and ensures outward positioning thereof in a locked relationship with the window.

Combined reference to FIGS. 4 through 6 shows that the window connector 32 is slidably supported on housing 14 for vertical movement that guides the window as it is raised and lowered between its open and closed positions. Housing guide portion 40 which interconnects the side walls 38 defines a shallow channel including a curved guide surface 152 that is convex in an outboard facing direction toward the environment as shown in FIG. 1. The outboard band reach 28 is slidably supported along surface 152 above and below the window connector 32. Adjacent the guide portion 40, the housing side walls 38 include grooves 154 that are curved in a parallel relationship with guide surface 152 and which open in opposite directions relative to each other. Slide portions 156 of window connector 32 are arranged in upper and lower opposed pairs and are received within the side wall grooves 154 to provide slidable support for the window connector as it is moved vertically. Window 12 is spaced from the connector 32 intermediate the ends 136 of its arm 118 as shown in FIG. 4 so that the connector leg 118 can flex laterally relative to the window as the window is raised or lowered. This flexing allows the front and rear edges of the window to also be guided by suitable vehicle guides that cooperate with the window regulator in supporting the window as it is moved upwardly and downwardly in a slightly curved path conforming to the curved shape of the window as viewed in FIG. 1.

It should be appreciated that while band 26 is frictional as disclosed, it could also have drive apertures that are positively driven by a sprocket type drive member through the one-way clutch 50.

While a preferred embodiment of the window regulator has been described in detail, those skilled in the art will recognize various alternative designs and embodiments for constructing window regulators of this invention a defined by the following claims.

What is claimed is:

1. A vehicle window regulator for moving a vehicle window between open and closed positions, the regulator comprising: upper and lower idler rollers mounted for rotation about respective axes that extend horizontally parallel to the window and to each other; a rotatable drive roller mounted vertically intermediate the upper and lower idler rollers about an axis perpendicular to a plane through the idler roller axes so as to be adaptable to be driven by a hand crank from within the vehicle on which the regulator is used; a band trained over the idler rollers and having a cross section with a greater lateral extent than its thickness; said band including inboard and outboard reaches extending between the idler rollers and forming a closed drive loop; said inboard reach of the band including a half twist such that the total lateral extent of the band engages the idler and drive rollers without stressing the band; and means for connecting the outboard reach of the band to the window to be controlled by the regulator such that manually driven rotation of the drive roller drives the band and thereby moves the window between the open and closed positions.

2. A vehicle window regulator for moving a vehicle window between open and closed positions, the regulator comprising: upper and lower idler rollers; a vertically extending housing including upper and lower ends respectively mounting the upper and lower idler rollers about respective axes that extend horizontally parallel to the window and to each other; a rotatable drive roller; said housing including an intermediate portion that mounts the drive roller vertically intermediate the upper and lower idler rollers about an axis perpendicular to a plane through the idler roller axes so as to be adaptable to be driven by a hand crank from within the vehicle on which the regulator is used; a band trained over the idler rollers and having a cross section with a greater lateral extent that its thickness; said band including inboard and outboard reaches extending between the idler rollers; said inboard reach of the band including a half twist such that the total lateral extent of the band engages the idler and drive rollers without stressing the band; and means for connecting the outboard reach of the band to the window to be controlled by the regulator such that manually driven rotation of the drive roller drives the band and thereby moves the window between the open and closed positions.

3. A regulator as in claim 2 wherein the housing includes spaced side walls intermediate which the inboard reach of the band extends between the idler rollers.

4. A regulator as in claim 3 further including upper and lower shafts extending between the side walls to rotatably support the idler rollers therebetween.

5. A regulator as in claim 2 wherein the intermediate portion of the housing includes pressure applying rollers that engage the band to maintain the engagement thereof with the drive roller.

6. A regulator as in claim 5 further including a counterbalance spring mounted by the intermediate portion of the housing.

7. A regulator as in claim 2 wherein the housing includes a curved guide surface over which the outboard reach of the band slides.

8. A regulator as in claim 2 further including a one way clutch that drives the drive roller to move the band but prevents reverse driving thereof due to forces applied to the band from the window.

9. A regulator as in claim 2 wherein the connecting means includes an adjuster for controlling the degree of tension in the band.

10. A vehicle window regulator for moving a vehicle window between open and closed positions, the regulator comprising: upper and lower idler rollers mounted for rotation about respective axes that extend horizonally parallel to the window and to each other; a rotatable drive roller mounted vertically intermediate the upper and lower idler rollers about an axis perpendicular to a plane through the idler roller axes so as to be adaptable to be driven by a hand crank from within the vehicle on which the regulator is used; a band trained over the idler rollers and having a cross section with a greater lateral extent than its thickness; the band including opposite ends and having inboard and outboard reaches extending between the idler rollers; said inboard reach of the band including a half twist such that the total lateral extent of the band engages the idler and drive rollers without stressing the band; means for connecting the outboard reach of the band to the window to be controlled by the regulator such that manually driven rotation of the roller drives the band and thereby moves the window between the open and closed positions; the connecting means including a connector for mounting on the window with the band ends secured thereto; and an adjuster including a threaded connection for securing one of the band ends to the connector so as to control the degree of tension in the band.

11. A regulator as in claim 10 wherein the connector includes a horizontally extending upper leg for mounting on the window and a vertically extending lower leg to which the band ends are secured.

12. A regulator as in claim 11 wherein the upper connector leg includes snap action attachers for securing the connector to the window.

13. A vehicle window regulator for moving a vehicle window between open and closed positions, the regulator comprising: a housing including upper and lower ends and an intermediate portion between the ends as well as an outboard guide portion extending between the ends; upper and lower idler rollers respectively mounted on the upper and lower ends of the housing for rotation about horizontal axes that are parallel to the window and to each other; a drive roller mounted on the intermediate portion of the housing for rotation about an axis perpendicular to a plane through the idler roller axes so as to be adaptable to be driven by a hand crank from within the vehicle on which the regulator is used; an elongated band trained over the idler rollers and having a cross section with a greater lateral extent than its thickness; said band inboard and outboard reaches extending between the idler rollers; the inboard reach of the band being trained over the drive roller and including a half twist such that the total lateral extent of the band engages the idler and drive rollers without stressing the band; and a connector for securing the outboard reach of the band to the window such that manually driven rotation of the drive roller drives the band and thereby moves the window between the open and closed positions.

14. A vehicle window regulator for moving a vehicle window between open and closed positions, the regulator comprising: a housing including upper and lower ends and an intermediate portion between the ends; side walls on the housing extending between the intermediate portion and the ends thereof in a spaced relationship to each other; upper and lower idler rollers respectively mounted on the upper and lower ends of the housing between the side walls for rotation about horizonal axes that are parallel to the window and to each other; a drive roller mounted on the intermediate portion of the housing for rotation about an axis perpendicular to a plane through the idler roller axes so as to be adapted to be driven by a hand crank from within the vehicle on which the regulator is used; a one way clutch that drives the drive roller when driven by the hand crank but prevents reverse driving thereof due to forces applied to the drive roller; an elongated band trained over the idler rollers and having opposite ends and a cross section therebetween with a greater lateral extent than its thickness; the band having an inboard reach extending between the idler rollers trained over the drive roller and including a half twist such that the total lateral extent of the band engages the idler and drive rollers without stressing the band; the band including an outboard reach along which the opposite ends thereof are disposed; a connector slidably supported on the guide portion of the housing and having the opposite ends of the band secured thereto; the connector including means for attaching the window thereto such that driving of the band by the drive roller moves the window between the open and closed positions; and an adjuster including a threaded connection for securing one of the band ends to the connector to control the degree of tension in the band.

15. A vehicle window regulator for moving a vehicle window between open and closed positions, the regulator comprising: a vertically elongated housing including upper and lower ends and an intermediate portion between the ends; said housing including a cross section between the ends having side walls and an outboard guide portion connecting the walls to define a U shape that opens in an inboard direction; the guide portion having an outer guide surface that is curved in a convex direction with respect to the environment and the side walls having outer surfaces with curved guide grooves extending parallel to the outer surface of the guide portion opening in opposite directions with respect to each other; upper and lower idler rollers mounted on the upper and lower ends of the housing for rotation about respective axes extending horizontally parallel to the window and to each other; a rotatable drive roller mounted on the intermediate portion of the housing for rotation about an axis perpendicular to a plane through the idler roller axes; a manually driven one way clutch for driving the drive roller while preventing reverse driving from forces applied to the drive roller; an elongated band trained over the idler rollers and having opposite ends and a cross section therebetween with a greater lateral extent than its thickness; the band having inboard and outboard reaches extending between the idler rollers; said inboard reach of the band being trained over the drive roller and having a half twist so the total lateral extent of the band engages the idler and drive rollers without stressing the band; pressure applying rollers rotatably mounted on the intermediate portion of the housing in rolling contact with the inboard reach of the band to maintain driving engagement thereof with the drive roller; said outboard reach of the band having the opposite band ends disposed therealong and being slidable along the curved guide surface of the guide portion; a connector to which the opposite ends of the band are attached and which includes slide portions that are slidably movable within the curved guide grooves of the housing side walls; the connector including means for securing the window thereto such that driving rotation of the drive rollers moves the band to move the window between the open and closed positions; and an adjuster including a threaded connection for securing one end of the band to the connector to control the degree of tension in the band.

* * * * *

UNITED STATES PATENT OFFICE

CERTIFICATE OF CORRECTION

Patent No. 4,095,370 Dated June 20, 1978

Inventor(s) Anthony A. Muehling

It is certified that error appears in the above-identified patent and that said Letters Patent are hereby corrected as shown below:

Column 1, line 64 "was" should be --has--.

Column 4, line 68 "wieght" should be --weight--.

Column 5, line 22 "recieves" should be --receives--.

Column 6, line 11 "a" should be --as--.

Column 6, line 50 "that" should be --than--.

Column 7, line 35 after "the" first instance, insert --drive--.

Column 10, line 4 "rollers" should be --roller--.

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*